US005200781A

United States Patent [19]

Hata

[11] Patent Number: 5,200,781

[45] Date of Patent: Apr. 6, 1993

[54] SHEET DISCHARGING TRAY FOR USE IN IMAGE FORMING APPARATUS

[75] Inventor: Masayuki Hata, Hachioji, Japan

[73] Assignee: Konica Corporation, Tokyo, Japan

[21] Appl. No.: 905,319

[22] Filed: Jun. 29, 1992

[30] Foreign Application Priority Data

Aug. 5, 1991 [JP] Japan ..... 3-61507[U]

[51] Int. Cl.[5] ..... G03G 15/00

[52] U.S. Cl. ..... 355/210; 355/200; 355/245; 355/260; 355/326; 355/321

[58] Field of Search ..... 355/321, 322, 309, 308, 355/210, 200, 245, 260, 326

[56] References Cited

U.S. PATENT DOCUMENTS

| | | | |
|---|---|---|---|
| 4,873,548 | 10/1989 | Kobayashi et al. | 355/200 |
| 4,896,191 | 1/1990 | Ohyabu et al. | 355/309 |
| 4,965,640 | 10/1990 | Watarai | 355/283 |
| 4,987,446 | 1/1991 | Mochimara | 355/200 |
| 5,005,053 | 4/1991 | Kozuka | 355/200 X |
| 5,036,358 | 7/1991 | Yoshida | 355/245 X |
| 5,065,195 | 11/1991 | Haneda et al. | 355/210 X |
| 5,103,261 | 4/1992 | Matsuo et al. | 355/210 |

*Primary Examiner*—Richard L. Moses
*Attorney, Agent, or Firm*—Finnegan, Henderson, Farabow, Garrett & Dunner

[57] ABSTRACT

An image forming machine having a lower body in which a feeder of recording sheets is disposed, and an upper body pivotally attached to the lower body in which an image carrier, at least one developing device and a developer container is disposed. The uppermost part of the upper body is provided with a sheet discharge tray for accommodating processed recording sheets. The machine is further provided with a openable cover pivotally attached to the upper body and disposed on the leading end of the tray in a discharging direction of the processed recording sheets. The cover forms an extension of the tray for accommodating the processed recording sheets moved from the tray and a protruded member at one end of the cover for preventing the processed recording sheets on the cover from falling down when the upper cover is opened.

6 Claims, 3 Drawing Sheets

SHEET DISCHARGING TRAY FOR USE IN IMAGE FORMING APPARATUS

BACKGROUND OF THE INVENTION

The present invention relates to a device in which recording sheets discharged onto the uppermost portion of an upper frame are prevented from slipping off when the upper frame is opened with respect to a lower frame in a recording or image forming apparatus.

Generally, in a recording apparatus or an image forming apparatus, when an image is formed or transferred onto a recording sheet, a method in which the recording sheet is discharged to be taken from the apparatus after an image has been formed on the recording sheet which is fed from a feeding device, is widely used. The apparatus can be made small by structuring the apparatus in the following manner: the recording sheet is discharged on a sheet discharging tray provided on the side of the apparatus. However, this is disadvantageous in that a required installation area of the entire apparatus becomes large because the sheet discharging tray protrudes from the side of the apparatus. When the recording sheet is discharged on an upper portion of the apparatus, in the image forming apparatus such as a printer whose upper portion is not used specifically, for example, there are advantages in that a protrusion of the sheet discharging tray is eliminated, and an installation area of the apparatus can be small. However, in the image forming apparatus such as a printer, the recording sheet is conveyed by a sheet feeding unit, a transfer unit, and the like, and since the recording sheet is jammed sometimes while being conveyed, it must be taken out from the apparatus.

As a structure in which the jammed recording sheet is taken out, a conveyance path is opened upward and downward so that the recording sheet can be taken out safely and rapidly. Generally, a method in which the entire apparatus is divided into two portions is widely used. However, when the above-mentioned method is used, there are the following problems in which: the sheet discharging tray is inclined naturally, and a number of recording sheets which have been discharged slip off from the apparatus, and thereby, the recording sheets become dirty, and the page order of the recording sheets which are discharged in order is disturbed.

SUMMARY OF THE INVENTION

An object of the present invention is to solve the problems by the following structure in which: a sheet discharging tray is provided on the uppermost portion of an image forming apparatus so that recording sheets are discharged on the sheet discharging tray in order; and a sheet slipping-off preventive member to prevent the recording sheet from slipping off is provided on an extended portion in the sheet discharging direction in which the recording sheets are discharged.

The present invention is structured as follows. In an image forming apparatus in which a recording sheet feeding unit is provided in a lower frame of the apparatus, a photoreceptor and developing devices are provided in an upper frame, and a sheet discharging tray is provided on the uppermost portion of the apparatus, a recording sheet slipping-off preventive member is provided on an end portion of an opening/closing cover by which developing agents are supplied to the developing devices, wherein the end portion of the cover corresponds to a leading edge portion of the sheet discharging tray in the recording sheet discharging direction.

DETAILED DESCRIPTION OF THE PREFERRED EMBODIMENT

Figure 1:
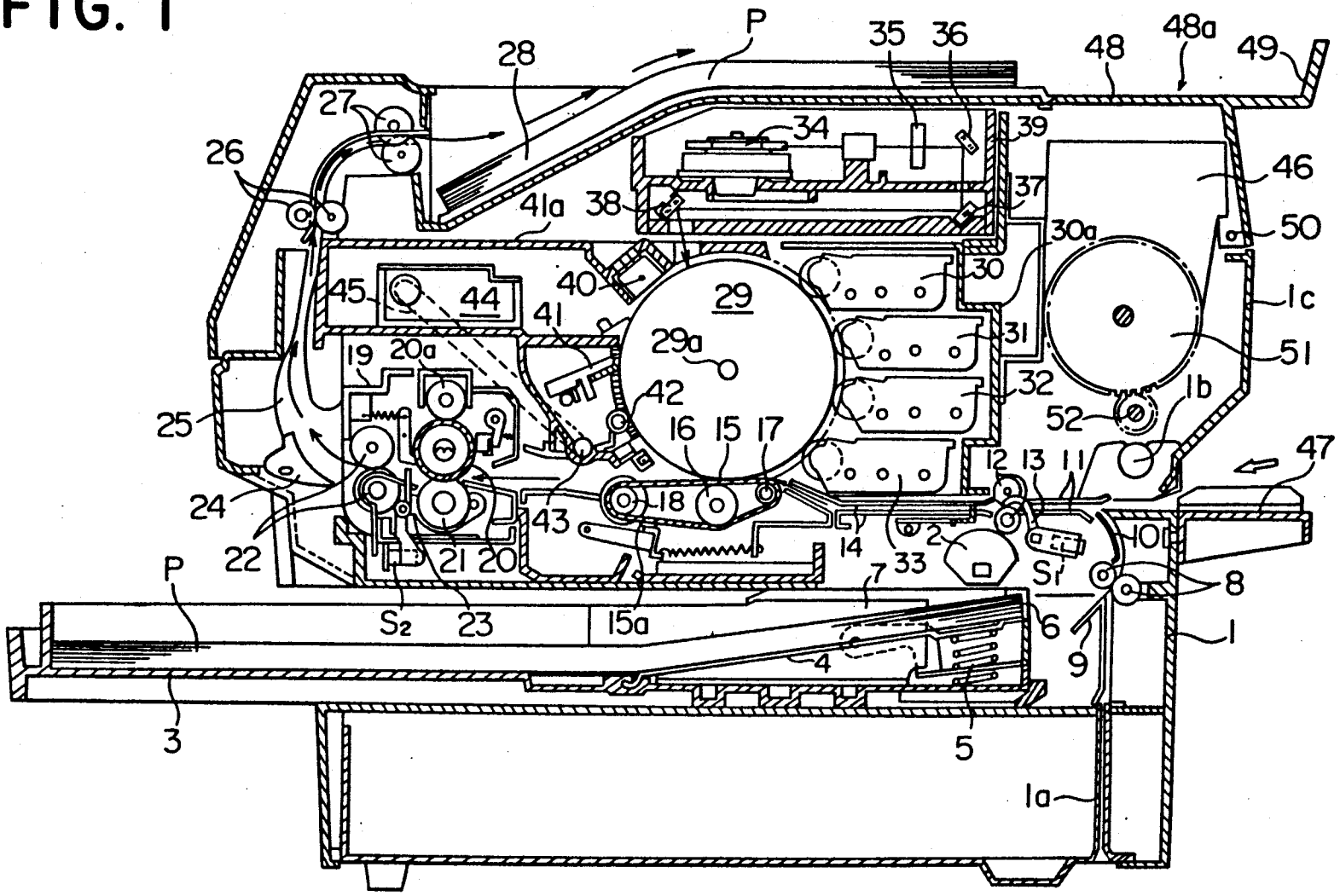
FIG. 1 is a vertical sectional view showing entirely the image forming apparatus on which a sheet discharging tray of the present invention is provided.

FIG. 1 is a view showing a structure of an embodiment of an image forming apparatus of the present invention which will be described as follows.

In FIG. 1, numeral 1 is a lower frame of the image forming apparatus in which a semicircular feeding roller 2 to feed recording sheet P is provided, and a feeding cassette 3 in which a plurality of recording sheets P are loaded is detachably provided. In the feeding cassette 3, a pushed plate 4 which is pushed upward by a spring 5 is provided so that recording sheet P can be placed in the cassette, and a separation claw rotatably provided in a portion of the feeding cassette 3 is engaged with the uppermost portion of leading edges of recording sheets P. Numeral 7 is a guide plate which guides both sides of recording sheet P, and is adjustably provided in the cassette according to sizes of recording sheet P. The above-described units are provided in the feeding cassette. Numeral 8 is a conveyance roller for recording sheet P provided in the lower frame 1, and the roller is provided between a g side plate 9 to guide the leading edge of recording sheet P fed by the feeding roller 2, and a reversal guide plate 10.

Numeral 11 is a guide plate which guides recording sheet P to registration rollers 12 after recording sheet P has been fed by reversal sheet feeding. Numeral 13 is a swinging member which turns ON or OFF a sensor S1 to detect recording sheet P at the position of the registration rollers 12. Numeral 14 is a guide plate which guides recording sheet P passed through the registration rollers 12 to the direction of a transferring belt 15, which is wound around a transferring roller 16, a roller 17, and a driving roller 18. Numeral **15*a* is a cleaning means which cleans the surface of the transferring belt 15. Numeral 19 is a fixing device which fixes an image transferred onto recording sheet P, and it comprises a fixing heat roller 20 and a contacting roller 21. The fixing heat roller 20 is contacted with a cleaning roller 20*a* with pressure so that the fixing heat roller 20 can be cleaned corresponding to its rotation. Numeral 22 is a sheet discharging roller which discharges recording sheet P from the fixing device 19, and a swinging member 23, which turns ON or OFF a sensor S2 in order to confirm that recording sheet P is discharged, is actuated by the recording sheet when recording sheet P is discharged. Recording sheet discharging is conducted in the following manner in which: recording sheet P is discharged onto a sheet discharging tray 28 provided on the entire surface of an upper portion of the upper frame 1*c* by means of a recording sheet guide member 24, a guide path 25 which is formed in the upper frame 1*c*, and guide conveyance rollers 26 and 27. Next, a photosensitive drum 29 for image forming is provided at almost central portion of the upper frame 1c, and a developing unit 30a is provided so that four developing devices 30, 31, 32, and 33 can be provided respectively from the upper portion along the surface of the photosensitive drum 29. Numeral 34 is a polygon mirror and laser light irradiated from a laser light source 35 is reflected by means of reflection mirrors 36, 37, and 38, and the photosensitive drum 29 is exposed thereby. Numeral 39 is an optical unit in which the optical systems such as the polygon mirror 34, reflection mirrors 36, 37, 38, and the like, are integrally provided, and it is incorporated into the uppermost portion of the upper frame 1c**.

Numeral 40 is a charging electrode which charges the entire surface of the photosensitive drum 29, and is provided in a portion of the upper frame 1c. Numeral 41 is a cleaning blade by which residual developing agents, which are adhered on the surface of the photosensitive drum 29, are cleaned after an image has been transferred onto recording sheet P from the photosensitive drum 29. A conveyance unit 43 is provided so that the cleaned developing agents can be received thereby and discharged to the outside, and a developing agent receiving member 42 is provided under the cleaning blade 41 so that the developing agents, which have been scraped off by the cleaning blade, can be conveyed efficiently to the conveyance unit. The developing agents, which have been conveyed to the outside by the conveyance unit 43, are conveyed into a vessel 44, the conveyed developing agents can be accumulated in the vessel 44 to a proper amount, and the vessel 44 is structured so that it can be removed and disused. Numeral 46 are developing agent vessels which supply developing agents to the developing devices 30, 31, 32, 33 respectively, although the developing agent vessel shown in the drawing is only one. They are structured in the following manner: four developing agent vessels are provided in parallel; and color developing agents such as, for example, cyan, magenta, yellow, and black are supplied to the developing devices 30, 31, 32, 33 so that color development can be conducted. Numeral 47 is a manual feeding unit by which recording sheet P can be manually fed. The lower frame 1 and the upper frame 1c are structured so that the conveyance path of recording sheet P can be opened around a support shaft 1b, and the upper frame 1c is opened around the support shaft 1b so that recording sheet P can be taken out when it can not be conveyed correctly and can not arrive at least to the fixing device while conveyed. A guide plate 1a by which recording sheet P can be supplied from another sheet feeding device (not shown in the drawings) is provided on the lower frame 1. The photosensitive drum 29 is provided in a frame 41a, on which the cleaning blade 41 is provided, through a shaft 29a which is pivotally supported by the upper frame 1c.

Numeral 48 is an opening/closing cover which is provided over the developing agent vessel and of which a portion of the upper frame 1c is composed. A portion of the opening/closing cover 48 forms a surface of a subsidiary sheet discharging tray 48a which is flush with that of the sheet discharging tray 28, and a sheet slipping-off preventive member 49 is integrated with the opening/closing cover 48 in the manner that the sheet slipping-off preventive member 49 is projected from the surface of the subsidiary sheet discharging tray 48a in order to prevent recording sheet P from slipping off. The opening/closing cover 48 is rotatably provided on the upper frame 1c by a hinge 50. Usually, the opening/closing cover 48 is locked by a locking member (for example, such as a magnet, or a protruded member) with respect to a portion of the upper frame 1c so that the cover can not be opened by a careless operation, and is structured in the manner that it can not be opened even when recording sheet P hits against the cover. Numeral 51 is a gear provided on the developing agent vessel 46, and the gear 51 meshes with a pinion 52 to drive the gear 51, and is rotated by rotation of the pinion 52 with an appropriate driving means. Developing agents contained in the developing agent vessels 46 are supplied to the developing devices 30, 31, 32, and 33 respectively by using the driving force of the gear. Accordingly, the number of the developing agent vessels 46 is the same as that of the developing units.

The present invention is structured as described above. Usually, as shown in FIG. 1, recording sheet P is fed from the feeding cassette 3 by the feeding roller 2, the image formed on the photosensitive drum 29 is transferred onto recording sheet P, and fixed by the fixing heat roller 20, and after that, recording sheet P is discharged and stacked successively on the sheet discharging tray 28 provided on the uppermost portion of the upper frame 1c as shown in the drawing.

Figure 2:
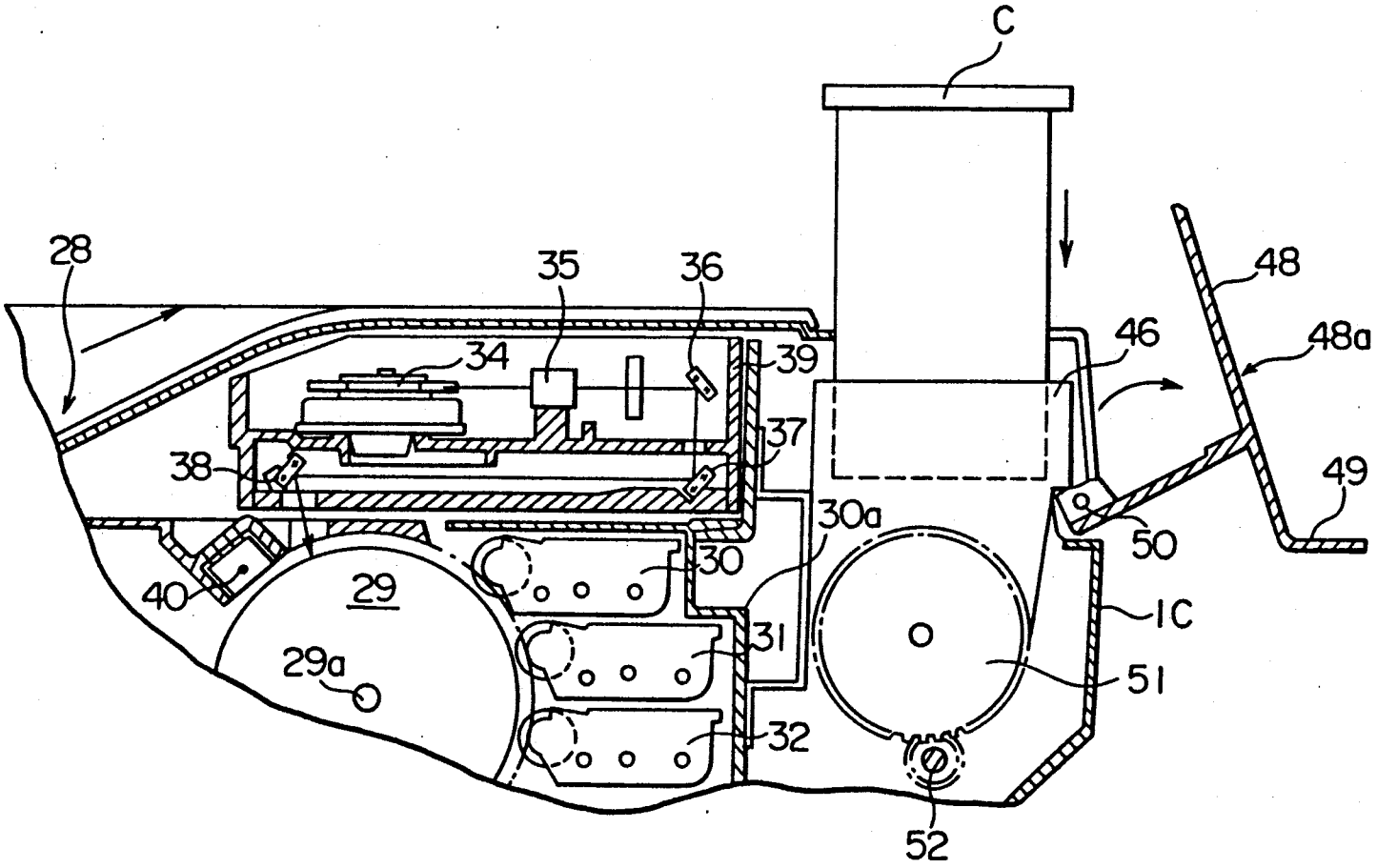
FIG. 2 is a vertical sectional view showing a condition in which a developing agent replenishing vessel is equipped on a developing agent vessel.

In FIG. 2, developing agent replenishing vessel C is mounted on the developing agent vessel 46, which is provided in the upper frame 1c, in order to supply developing agents. When the opening/closing cover 48 is opened in the arrowed direction in FIG. 2, and an opening for toner supply of the developing agent vessel 46 is opened, the opening/closing cover 48 can be easily opened by pushing outward the sheet slipping-off preventive member 49 provided on an end portion of the cover 48, and releasing the lock member.

Figure 3:
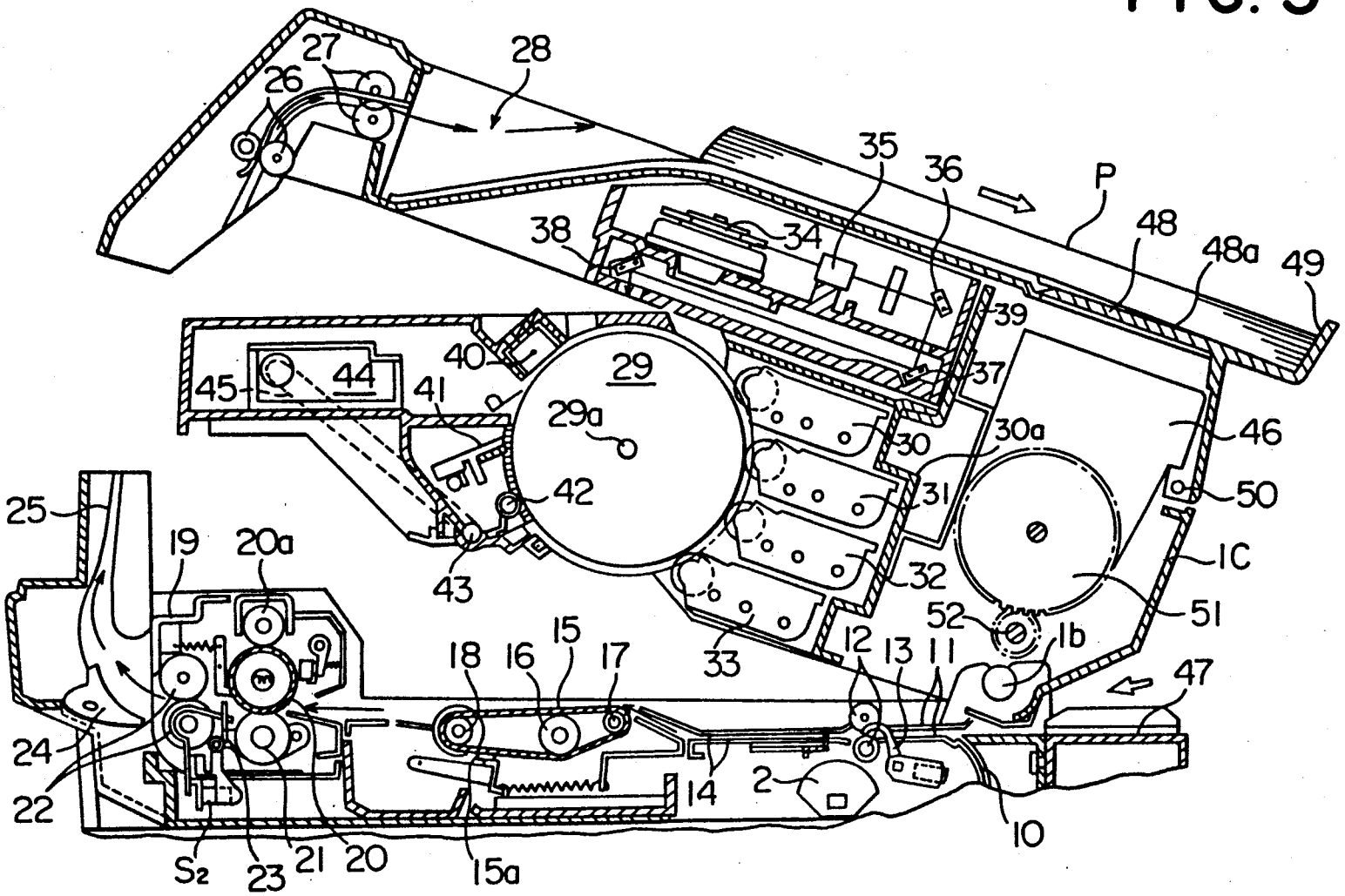
FIG. 3 is a vertical sectional view showing a condition in which a lower frame of the apparatus is separated from an upper frame thereof.

In FIG. 3, when recording sheet P is jammed in the conveyance path of the image forming apparatus, and jam clearance is required, the conveyance path is opened in the manner that the upper frame 1c is opened with respect to the lower frame 1 around the support shaft 1b. However, when the upper frame 1c is opened, the integrally provided sheet discharging tray 28 is largely inclined, and a lot of discharged recording sheets P are moved on the sheet discharging tray 28 in the inclined direction. However, one end portion of recording sheet P is prevented from moving by the sheet slipping-off preventive member 49, so that recording sheet P can be prevented from slipping off.

As described above, in an image forming apparatus of the present invention, such as a copying apparatus or a printer, which is structured in the manner that: a sheet discharging tray is provided on the uppermost portion of the apparatus so that the entire body of the apparatus can be small; and when recording sheet jamming is caused in the image forming apparatus, recording sheet P which has been discharged can not be slipped off from the tray even when an upper frame is opened with respect to a lower frame, the sheet discharging tray is used also for an opening/closing cover which is opened when developing agents are supplied to developing agent vessels, and functions as a grip for opening the opening/closing cover and a sheet slipping-off preventive member, and therefore there are effects in which a grip for the exclusive use in the opening/closing cover is not necessary, and the like.

What is claimed is:

1. An image forming apparatus having a lower body in which means for feeding recording sheets is disposed, and an upper body in which an image carrying member, developing means and a developer container are disposed, the uppermost part of said upper body being provided with a sheet discharge tray for accommodating processed recording sheets, said apparatus comprising:

(a) a cover provided above said container and on the leading end of said tray in a discharging direction of said processed recording sheets, having a closed position and an open position at which replenishment developer is supplied to said container, said cover forming an extension of said tray for accommodating said processed sheets moved from said tray; and (b) a member provided to one end of said cover, for preventing said processed recording sheets on said cover from falling down.

2. The apparatus of claim 1, wherein said extension is substantially flush with a top surface of said tray.

3. The apparatus of claim 1, wherein said member is integrally provided to said cover and is upwardly protruded from said extension.

4. The apparatus of claim 1, wherein said cover is pivotally attached to said upper body.

5. The apparatus of claim 4, further comprising means for locking said cover, wherein when said replacement developer is supplied to said container said locking means is released to open said cover.

6. A color image forming apparatus having a lower body in which means for feeding recording sheets is disposed, and an upper body in which an image carrying member, a plurality of developing means and a plurality of developer containers are disposed, the uppermost part of said upper body being provided with a sheet discharge tray for accommodating processed recording sheets, said apparatus comprising:

(a) a cover provided above said plurality of containers and provided to the leading end of said tray in a discharging direction of said processed recording sheets, having a closed position and an open position at which each different colored replenishment developer is supplied to each of said containers, said cover forming an extension of said tray, said extension being substantially flush with a top surface of said tray for accommodating said processed recording sheets moved from said tray, said cover being pivotally attached to said upper body; and (b) a member integrally provided to one end of said cover and upwardly protruded from said extension, for preventing said processed recording sheets on said cover from falling down.

* * * * *